United States Patent [19]

Owen et al.

[11] 4,012,455

[45] Mar. 15, 1977

[54] UPGRADING REFINERY LIGHT OLEFINS WITH HYDROGEN CONTRIBUTOR

[75] Inventors: Hartley Owen, Belle Mead; Paul B. Venuto, Cherry Hill, both of N.J.

[73] Assignee: Mobil Oil Corporation, New York, N.Y.

[22] Filed: July 31, 1974

[21] Appl. No.: 493,296

[52] U.S. Cl. ..... 260/668 R; 260/683 R

[51] Int. Cl.[2] ..... C07C 15/02

[58] Field of Search ..... 260/668 R, 682, 676, 260/671, 677, 672 T, 668 A; 208/135, 141, 118, 120

[56] References Cited

UNITED STATES PATENTS

| | | | |
|---|---|---|---|
| 3,728,408 | 4/1973 | Tobias | 260/668 C |
| 3,849,291 | 11/1974 | Owen | 208/78 |
| 3,856,873 | 12/1974 | Burress | 260/672 T |
| 3,894,107 | 7/1975 | Butter et al. | 260/673 |

*Primary Examiner*—D. Horwitz

*Attorney, Agent, or Firm*—Charles A. Huggett; Carl D. Farnsworth

[57] ABSTRACT

A combination operation is described and method for upgrading $C_2$–$C_5$ olefin rich streams with selective crystalline zeolite compositions in a fluidized catalyst system at relatively low pressures by reaction with hydrogen or a carbon-hydrogen fragment contributor, such as methanol, to form gasoline and light fuel oil boiling range products.

1 Claim, 1 Drawing Figure

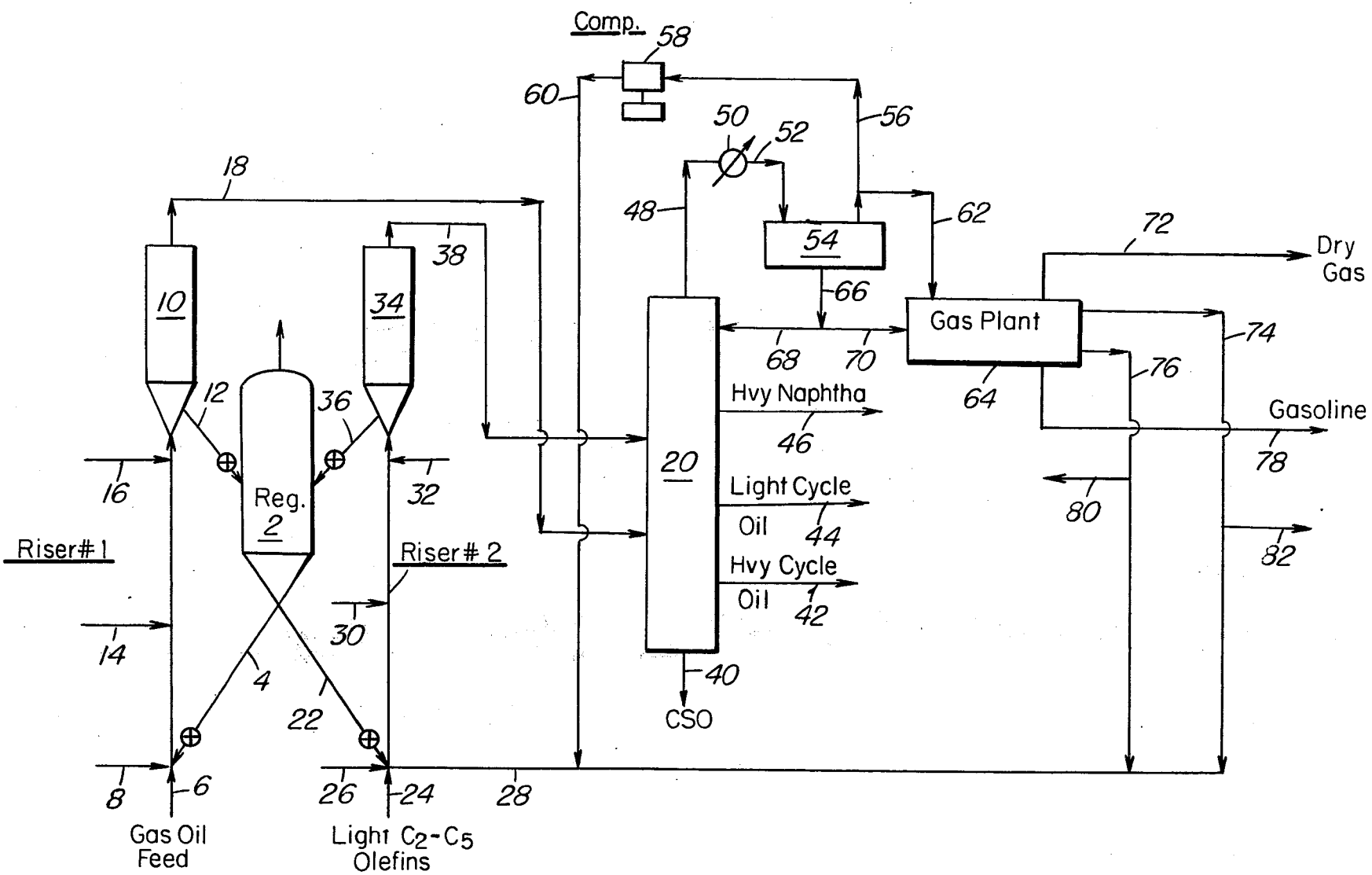
Dry Gas
Gasoline
Gas Plant
Hvy Naphtha
Light Cycle Oil
Hvy Cycle Oil
CSO
Comp.
Reg. 2
Riser # 2
Riser # 1
Light C2-C5 Olefins
Gas Oil Feed

UPGRADING REFINERY LIGHT OLEFINS WITH HYDROGEN CONTRIBUTOR

BACKGROUND OF THE INVENTION

With the advent of fossil fuel shortages and the accelerating demand for petroleum derived products, the refiner is faced with many problems associated with producing notably high octane gasoline and good quality light distillates. In their efforts to optimize gasoline production, refiners are forced to consider more efficient methods of utilizing refinery light gases, particularly $C_2$–$C_5$ olefin streams in cooperation with advanced technology for the purpose identified. Although these materials can be used as feed for alkylation (sulfuric and HF processes), the refiner is frequently faced with shortages of isobutane needed for these processes forcing the purchase of isobutane from outside short supply sources when available at relatively high prices. However, this not only escalates the cost but also the shortage of an already expensive material. Therefore any modern processing technology which will circumvent this problem for the refiner becomes an exceedingly valuable tool for the industry.

Some typical refinery light gases suitable for such upgrading include catalytic cracker off gases, coker off gas, visbreaker off gas, and the effluent gas of any process producing ($C_2$–$C_5$) light olefins.

SUMMARY OF THE INVENTION

The present invention is concerned with upgrading low molecular weight gaseous hydrocarbon streams and particularly $C_2$–$C_5$ olefinic gaseous streams. More particularly, the present invention is directed to a combination operation wherein a gaseous olefin stream is combined with a hydrogen contributing material and passed in contact with a selected crystalline zeolite conversion catalyst under conditions selected to obtain upgrading of the olefins to relatively high yields of high octane gasoline product. Under some selected processing conditions, conversions of the olefins to high quality distillate fuels is possible or under other selected operating conditions, relatively high yields of isobutane as product is possible.

In the combination operation of the present invention, $C_2$–$C_5$ olefin rich streams are upgraded more efficiently in a fluidized catalyst system at relatively low pressures, such as employed in fluid cracking operations, by reaction with a hydrogen or carbon-hydrogen fragment contributor, such as methanol, to form a desired product and particularly a high octane gasoline and/or light fuel oil product. Use of a fluidized crystalline zeolite catalyst system or systems maximizes facile intermolecular hydrogen transfer reactions, and minimizes problems due to diffusion limitations and/or heat transfer.

Methanol is expected to be available in quantity, either as a transportable product from overseas natural gas conversion processes, or as a product from large scale coal, shale, or tar sands gasification. The process of the present invention can also utilize carbon monoxide (in combination with a cheap source of supply of hydrogen such as water and/or methanol) which gas is readily available from refinery regeneration flue gas, or from coal, shale, tar sands gasification and combustion processes.

The processing concepts of the present invention are preferably carried out in a riser conversion zone or a dispersed catalyst phase conversion operation. It is also possible to employ dense fluid catalyst bed operations, moving catalyst bed and fixed catalyst bed systems. Single and multistage operations may also be employed. In addition the processing concepts of this invention may include:

1. A dual riser conversion operation maintained under different operating conditions of temperature, space velocity and catalyst/oil ratio, and low molecular weight hydrogen contributing agent.
2. Cascade and/or recycle of used catalyst before regeneration to regulate catalyst/oil ratio and catalyst activity/selectivity characteristics.
3. Provisions for multiple injection of low molecular weight hydrogen contributing material along a riser conversion zone.
4. Provisions for the efficient recycle of unreacted materials separated from the products of the process.

By low molecular weight hydrogen contributing agent and/or carbon-hydrogen fragments contributor is meant one or more materials selected from the group comprising methanol, $C_2$–$C_5$ alcohols and aliphatic ethers; $C_2$–$C_5$ acetals, aldehydes and ketones; methyl mercaptan, $C_2$–$C_5$ mercaptans and aliphatic thioethers; methyl amines, quaternary ammonium compounds and haloalkanes such as methyl chloride. Carbon monoxide and combinations of $CO + H_2O$, $CO + H_2$ $CO +$ alcohol etc. may also be employed. It is preferred to employ methanol.

The catalyst employed is preferably a crystalline zeolite material of selected characteristics. A catalyst with a "hydrogen activating function" is preferred when carbon monoxide is a reactant. The catalyst is an acidic composition comprising a crystalline zeolite of selected characteristics selected from the group comprising ZSM-5 type crystalline zeolites, mordenite type crystalline zeolites, dealuminized mordenite and combinations thereof with or without the presence of a large pore crystalline zeolite of the X and Y faujasite type and intimately dispersed in an organic oxide matrix material.

The catalyst above identified and provided with a "hydrogen activating function" is meant to include one of several classes of catalysts which aid in the redistribution of transfer of mobile hydrogen, or which are classified as hydrogen dissociation, hydrogen activation or hydrogenation catalysts. They may contain a hydrogenating metal function such as Pt, Ni, Fe, Re, W, Mo, Co, Th, Cr, Ru, V or Cu. Catalyst functions also known in the art to catalyze the Fischer-Trosch reaction, the water gas shift reaction, and olefin disproportionation may be particularly preferred.

Thus, the catalyst may be either a small pore crystalline zeolite or a dual cracking component catalyst comprising a mixture of crystalline zeolites of large and small pore size having mobile hydrogen transfer capability which may be enhanced with a hydrogenating method function.

BRIEF DESCRIPTION OF THE DRAWING

The drawing is a diagrammatic sketch in elevation of a dual riser conversion operation with common catalyst regeneration means and product separation of practicing the concepts of invention herein expressed.

DISCUSSION OF SPECIFIC EMBODIMENTS

EXAMPLE 1

A low-boiling olefinic charge stock consisting of cis-2-butene (3.8 wt.%), 1-pentene (47.1 wt.%) and 1-hexene 49.1 wt.%) simulating a refinery light olefin stream was prepared. The measured R+O octane number of this hydrocarbon charge (butene-free basis) was 83.5 R+O. Methanol was added to this charge in such quantity that the ratio of methanol/hydrocarbon was 0.581/1.00; this corresponded to a ratio of 1.38 moles of methanol/mole of hydrocarbon. The measured specific gravity of this combined feed was about 0.695 at about 60° F.

The combined hydrocarbon-methanol feed (total of 20.43 grams over 4 min.) was pumped through the inlet of the feed preheater of a 30-ft bench scale riser FCC pilot plant unit. Stocks were intimately mixed in the feed preheater at 500° F., then admitted to the riser inlet where hot (833° F) catalyst, 40% ZSM-5 in silica/alumina matrix) was admitted and catalytic conversion allowed to occur. Riser inlet mix was 790° F. and reactor temperature was 900° F. The ratio of catalyst to feed (hydrocarbon + methanol) was 18.3 (wt/wt), catalyst residence time was about 10 sec., riser inlet pressure was 30 psig, and ratio of catalyst residence time to oil residence time was 1.26. Riser effluent was then passed through a nitrogen gas-stripping chamber and gaseous effluent was separated from spent catalyst (0.197 wt.% carbon) and the gaseous (17.4L at 80° F) and liquid (5.6g, S.G. 0.8115 at 60° F) products collected, separated by distillation and analyzed. This run is numbered H-619. Data for the reaction conditions, overall product selectivities and liquid product (gasoline) inspections are shown in Tables 1, 2 and 3, respectively.

Table 1

Reaction of Methanol With Very Light Olefinic $C_5/C_6$ Gasoline Over Zeolite Catalyst

| OPERATING CONDITIONS | Reaction Conditions Run H-619 |
|---|---|
| Reactor Inlet Temp., ° F[a] | 900 |
| Oil Temp., ° F | 500 |
| Catalyst Inlet Temp., ° F | 833 |
| Catalyst/Oil (Wt/Wt) Ratio | 18.3 |
| Catalyst Residence Time, Sec. | 9.8 |
| Reactor Pressure, Inlet, psig | 30.0 |
| Carbon, Spent Catalyst, % Wt | 0.197 |
| Slip Ratio | 1.26 |
| Catalyst | 40% ZSM-5 (70/1 $SiO_2/Al_2O_3$ ratio) in silica/alumina matrix [b] |
| Methanol, Wt % of Light Gasoline | 58.1 |
| Molar Ratio, Methanol/[c] Light Gasoline | 1.38 |

[a] Mix temperature was 790° F at reactor inlet
[b] Elutriated, unsteamed; matrix contains 13% $Al_2O_3$, no clay.
[c] No $CH_3OH$ or $(CH_3)_2O$ were detected in the gaseous product Table 2

Product Selectivities (No-Loss Basis [a])

| Run | H-619 |
|---|---|
| Product | Wt.% |
| $C_5^+$ Gasoline | 66.94 |
| Total $C_4$ | 26.69 |
| Dry Gas | 2.49 |
| Coke | 3.88 |
| Cycle Oil | 0.00 |
| Light-Hydrocarbon Product Breakdown, Wt.% | |
| $H_2S$ | 0.15 |
| $H_2$ | 0.00 |
| $C_1$ | 0.00 |

Table 2-continued

Product Selectivities (No-Loss Basis [a])

| | |
|---|---|
| $C_2^=$ | 0.00 |
| $C_2$ | 0.10 |
| $C_3^=$ | 0.68 |
| $C_3$ | 1.55 |
| $C_4^=$ | 8.91 |
| i-$C_4$ [c] | 12.30 |
| n-$C_4$ | 5.49 |
| $C_5^=$ | 3.34 |
| i-$C_5$ [d] | 15.17 |
| n-$C_5$ | 2.53 |
| Recovery [b] | 63.0 |

[a] I.e., based on total weight of hydrocarbon products = coke recovered
[b] Theoretical recovery based on loss of 1 mole $H_2O$/mole $CH_3OH$ is 83.9%
[c] i-/n - $C_4$ ratio (Wt/Wt) = 2.24
[d] i-/n - $C_5$ ratio (Wt/Wt) = 4.54

Table 3

Gasoline Inspections

| | | H-619 |
|---|---|---|
| Sp. Grav., 60° F [a] | | 0.8115 |
| API Grav., 60° F [a] | | 42.9 |
| R+O Octane lbs., $C_5^+$, Raw [a][b] | | 99.3 |
| R+O Octane lbs., $C_5^+$, adjusted | | 95.0 |
| Hydrocarbon Type, $C_5^+$ - Basis, Wt% | | |
| Paraffins | 29.5[d] | |
| Olefins | 2.8[d] | |
| Naphthenes | 4.2 | |
| Aromatics | 63.5[e] | |
| | 100.0 | |
| % H | | 12.12 |
| M.W. | | 97.4 |

| | Paraffins | Aromatics |
|---|---|---|
| $C_5$ | 31.0 | — |
| $C_6$ | 38.1 | 2.8 |
| $C_7$ | 10.9 | 18.2 |
| $C_8$ | 12.9 | 35.6 |
| $C_9$ | 6.5 | 28.7 |
| $C_{10}$ | 0.5 | 10.9 |
| $C_{11}$ | 0 | 3.8 |
| $C_{12}$ | 0 | 0 |

[a] On Raw gasoline as recovered in product receiver
[b] R+O calculated
[c] R+O adjusted subtract out $C_4^-$ from gasoline and adds in $C_5^+$ in gas
[d] Pentenes only; no $C_6$ or higher olefins
[e] Carbon lbs. Breakdown, Wt %, Normalized From Table 3 it is evident that under the conditions of this run, almost complete conversion of the $C_5/C_6$ olefins occurred, with recovery of high yields (66.94 wt.%) of a liquid hydrocarbon gasoline-range product with very high (95.0 $C_5$ + R+O) octane number, over 11.5 units higher than that of the 1-pentene/1-hexene used as feed (R+O = 83.5). From Table 3, it can be seen that 82.5 wt.% of the aromatics in the gasoline are in the $C_7$–$C_9$ range, with only 2.8 wt.% benzene, and only 14.7 wt.% $C_{10}$–$C_{11}$. There were no $C_{12}$+ aromatics present. Only 3.88 wt.% of total recovered products was coke, and of the $C_4$-products (29.18 wt.%), 91.4% was a mixture of i-$C_4$ : n-$C_4$ : $C_4$ = in ratio of 1:0.45:0.72. The i-$C_4$/n-$C_4$ mixture could be used for vapor pressure adjustment of the gasoline, or, if desired, i-$C_4$ could be used to alkylate the $C_4$= and $C_3$= olefins present in the products. If alkylation is desired, the stoichiometry is such that all the $C_3$/$C_4$ olefins can be converted to high quality alkylate, with an excess of isobutane still available for outside sale or other uses. Alternatively, all the isobutane could be sold, etc., and the $C_3$=/$C_4$= olefins recycled to the FCC.

Referring now to the drawing there is shown diagrammatically a dual riser fluid catalyst system comprising riser No. 1 and riser No. 2 supplied with hot regenerated catalyst from a common regenerator. Under some circumstances it may be preferred to employ different catalysts in each riser, thus requiring separate regeneration systems. For the sake of simplicity a single regenerator is shown in a system using the same catalyst composition such as a ZSM-5 crystalline zeolite dispersed in an inert or catalytically active silica alumina matrix material. A larger pore crystalline zeolite such as Y faujasite may be used in combination with the ZSM-5 silica-alumina mixture or dispersed on a separate matrix material before admixture with the smaller pore ZSM-5 catalyst. The matrix material is preferably relatively low in catalytic activity.

In the arrangement of the figure the herein described cracking catalyst of desired particle and pore size is passed from a regeneration zone 2 by conduit 4 to the bottom or lower portion of a riser conversion zone identified as riser No. 1. A gas oil boiling range charge material and/or heavier recycle material is introduced by conduit 6 and admixed with hot regenerated catalyst charged to the lower portion of riser No. 1 by conduit 4 to form a suspension thereof at a temperature of at least 960° F. and more usually at least about 1000° F. An upper temperature limit within the range of 1150° to 1200° F. is contemplated. In addition a hydrogen contributing material such as methanol is introduced by conduit 8 to the suspension or it may be first admixed with the gas oil feed or after the gas oil feed comes in contact with the hot regenerated catalyst. The suspension thus formed of catalyst and hydrocarbon is passed upwardly through the riser under velocity conditions providing a hydrocarbon residence time within the range of 1 to 30 seconds before discharge and separation in separator 10. In separator 10, the riser may terminate by discharging directly into a plurality of cyclonic separators or terminate in substantially an open ended conduit discharging into an enlarged separation zone as taught and described in the prior art. It is preferred to employ cyclonic separation means on the riser discharge however to separate and recover a catalyst phase from a vaporous hydrocarbon phase. The separated catalyst phase is collected in the lower portion of zone 10 and transferred by conduit 12 to regeneration zone 2. Conduits 14 and 16 are provided for adding any one or both of the reactant materials to riser No. 1. The products of the gas oil riser conversion operation are withdrawn from separator 10 by conduit 18 and passed to a fractionation zone 20.

Regenerated catalyst at an elevated temperature up to about 1400° F is also withdrawn from regenerator 2 for passage by conduit 22 to the bottom lower portion of riser No. 2. Light $C_2$–$C_5$ olefins introduced by conduit 24 to the bottom lower portion of riser No. 2 combine to form a suspension with the hot catalyst introduced. A hydrogen contributor such as methanol is also introduced to riser No. 2 as by conduit 26 or to a downstream portion thereof by conduits 30 and 32. On the other hand it may be mixed with olefin feed before contacting the catalyst. Recycle gaseous products of the process recovered as more fully discussed below are passed to the lower portion of riser No. 2 by conduit 28. The suspension thus formed at a temperature in the range of 500° F to 900° F at a catalyst to olefin ratio in the range of 1 to 40 is then passed upwardly through riser No. 2 under conditions to provide a vapor residence time within the range of 1 to 30 seconds. Additional methanol may be added to the riser by conduits 30 and 32 or olefinic constituents above may be separately added in the event the ratio of methanol to olefinic material exceeds a desired limit.

Riser No. 2 discharges into a separation zone 34 which may or may not be the same as separator 10. In any event separation of catalyst from vaporous material is made under conditions desired. The separated catalyst is collected, stripped and then passed by conduit 36 to the regenerator 2. The reaction products of riser No. 2 separated from the catalyst in separator 34 are passed by conduit 38 to fractionator 20. In the combination operation of this invention, the gas oil products of conversion are introduced to a lower portion of the fractionator 20 with the products of olefinic conversion in riser No. 2 being discharged in a more upper portion of fractionator 20.

In fractionation zone 20, the introduced products are separated. A clarified slurry oil is withdrawn from a bottom portion of tower 20 by conduit 40; a heavy cycle oil is withdrawn by conduit 42, a light cycle oil is withdrawn by conduit 44 and a heavy naphtha fraction is withdrawn by conduit 46. Material lower boiling than the heavy naphtha is withdrawn from the tower as by conduit 48, cooled by cooler 50 to a temperature of about 100° F before passing by conduit 52 to knockout drum 54. In drum 54 a separation is made between vaporous and liquid materials. Vaporous material comprising $C_5$ and lower boiling gases are withdrawn by conduit 56, passed to compressor 58 and recycled by conduit 60 and 28 to the lower portion of riser No. 2. A portion of the vaporous $C_5$-material is passed by conduit 62 to a gas plant 64. Liquid material recovered in drum 54 is withdrawn by conduit 66 and recycled in part as reflux by conduit 68 to tower 20. The remaining portion of the recovered liquid is passed by conduit 70 to gas plant 64.

In gas plant 64 a separation is made of the $C_5$- products and liquid product to permit the recovery of dry gases comprising $C_3$- materials as by conduit 72, a methanol/ether rich stream as by conduit 74, a light olefin rich stream as by conduit 76 and a light gasoline stream by conduit 78. The methanol rich stream and the olefin rich stream may be recycled to riser No. 2 as shown. A portion of the light olefin rich stream may be withdrawn by conduit 80 and passed to alkylation. A portion of the methanol rich stream withdrawn by conduit 82 of the olefin rich stream in conduit 80 may be charged to the gas oil riser cracking unit as by conduit 8. It is also to be understood that any one of heavy naphtha, light cycle oil, heavy cycle oil or a combination thereof may be recycled particularly to the gas oil riser cracking unit. On the other hand, the heavy naphtha in conduit 46 may be combined with methanol and converted in a separate riser conversion zone with a ZSM-5 type crystalline zeolite catalyst. In the combination operation herein described it is preferred to effect conversion of a mixture of methanol with naphtha in a separate dense fluid catalyst bed conversion zone not shown and provided with its own catalyst regeneration system. On the other hand, a fixed bed reactor arrangement may be used with the combination herein discussed and relied upon for effecting conversion of methanol and naphtha to gasoline boiling products in the presence of a ZSM-5 type crystalline zeolite.

Having thus generally described the method and system of the present invention and discussed specific embodiments in support thereof, it is to be understood that no undue restrictions are to be imposed by reason thereof except as defined by the following claims.

We claim:

1. A method for upgrading hydrocarbons which comprises converting a gas oil boiling range hydrocarbon material combined with methanol by contact with a ZSM-5 type zeolite and faujasite as a suspension in a first riser conversion zone at a temperature within the range of 960° F to about 1200° F, separating the product of said first riser conversion zone to recover a stream comprising $C_2$–$C_5$ olefins from higher boiling components comprising gasoline, heavy naphtha, light cycle oil and heavy cycle oil, converting $C_2$–$C_5$ light olefins combined with methanol by contact with a ZSM-5 type zeolite and faujasite catalyst as a suspension in a second riser conversion zone at a temperature in the range of 500° to about 900° F and a contact time of 1 to 30 seconds, separating the products of said second conversion zone in the presence of the products from the first conversion zone, recycling separated light olefins and separated methanol to at least said second conversion zone.

* * * * *